United States Patent [19]

Roehlich et al.

[11] 4,169,278

[45] Sep. 25, 1979

[54] FIRE-SUPPRESSING FOAM LEVEL CONTROLLER

[75] Inventors: Ferdinand Roehlich, Allison Park; Robert L. Rankin, Butler, both of Pa.

[73] Assignee: Mine Safety Appliances Company, Pittsburgh, Pa.

[21] Appl. No.: 883,368

[22] Filed: Mar. 6, 1978

[51] Int. Cl.[2] ..... H01H 47/12

[52] U.S. Cl. ..... 361/178; 137/392; 169/61

[58] Field of Search ..... 361/178; 137/392, 393; 169/61

[56] References Cited

U.S. PATENT DOCUMENTS

| | | | |
|---|---|---|---|
| 1,463,986 | 8/1923 | Wherland | 361/178 UX |
| 2,249,994 | 7/1941 | Warrick | 361/178 |
| 3,131,335 | 4/1964 | Berglund et al. | 137/392 X |

*Primary Examiner*—J D Miller
*Assistant Examiner*—L. Schroeder
*Attorney, Agent, or Firm*—Brown, Flick & Peckham

[57] ABSTRACT

An electric circuit for energizing a fire-suppressing foam generator includes a switch that is opened and closed by means operated by electric control circuits, one of which contains a pair of laterally spaced lower electric probe contacts mounted in the protected area and adapted to be bridged by a rising level of foam to close that circuit. The other control circuit contains a pair of laterally spaced upper electric probe contacts above the level of the lower contacts and adapted to be bridged by a rising level of foam to close the last-mentioned control circuit.

8 Claims, 3 Drawing Figures

FIRE-SUPPRESSING FOAM LEVEL CONTROLLER

It is among the objects of this invention to provide foam level controlling apparatus which determines the maximum and minimum depths of fire-suppressing foam in an area, which raises the foam level again when the foam falls from its upper level to its predetermined lower level, which conserves foam, and which does all of this automatically and dependably.

Figure 1:
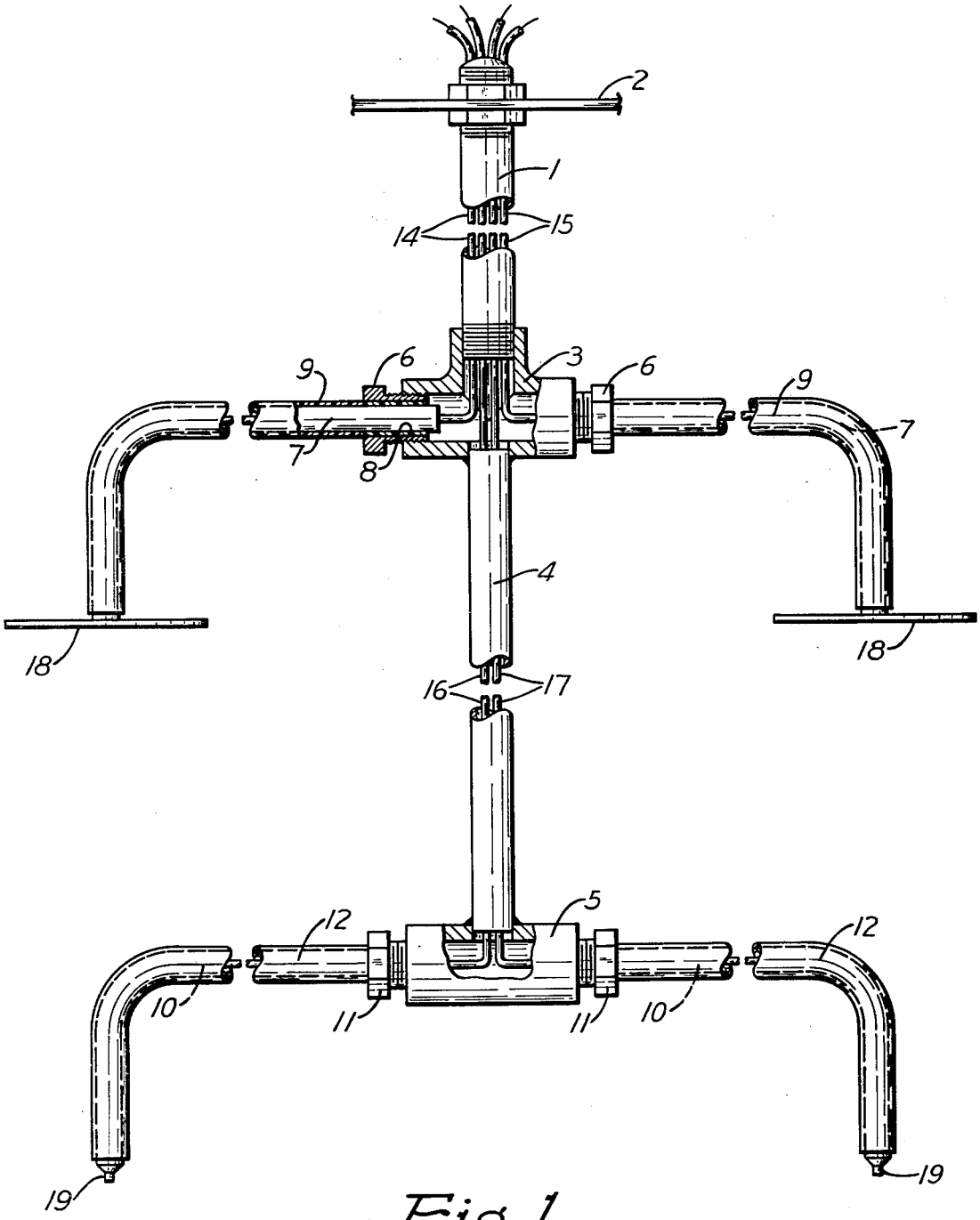
Figure 2:
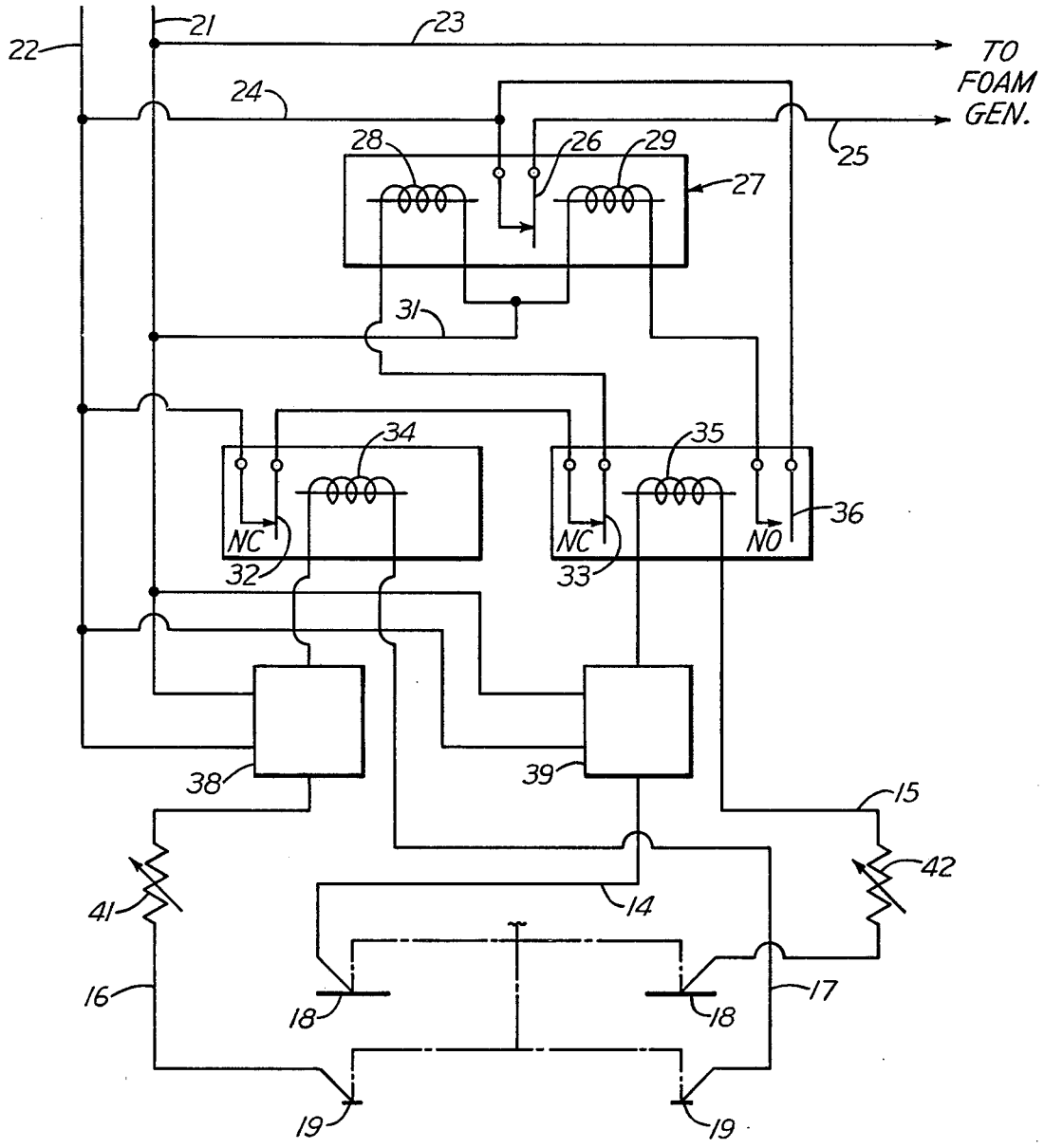
Figure 3:
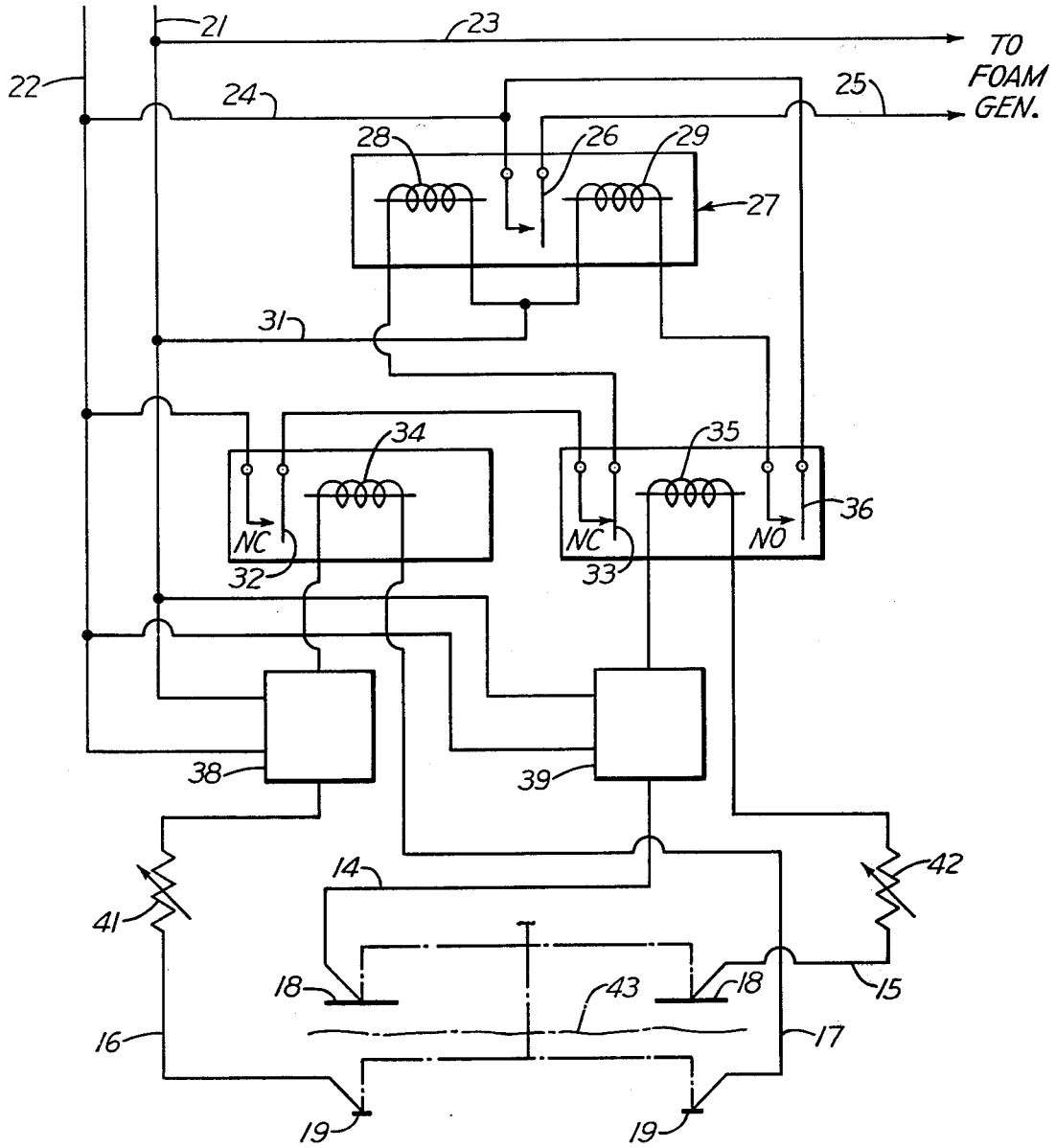

The preferred embodiment of the invention is illustrated in the accompanying drawings, in which FIG. 1 is a side view, partly broken away in section, of the foam engaging apparatus;

FIG. 2 is a circuit diagram, with the different elements in position for generating foam; and FIG. 3 is the same circuit diagram, with the different elements in the position they occupy while foam generation has stopped and the foam level is falling.

Referring to FIG. 1 of the drawings, in an enclosed area, such as a room, office, storage area or factory, that is to be protected by a fire-suppressing foam the upper end of a vertical pipe 1 is mounted in a ceiling number 2 or other overhead support. Connected to the lower end of this pipe there is a T-fitting 3 with an opening in its bottom, in which the upper end of a second vertical pipe 4 is secured. The lower end of this second pipe is rigidly mounted in an opening in the top of a horizontal pipe fitting 5, which could be a T-fitting if desired. Screwed into the opposite ends of T-fitting 3 are bushings 6, in which the ends of a pair of metal tubes 7 are disposed. Each of these tubes is insulated from the encircling bushing by a cylindrical sleeve 8 of insulating material. Extending along each tube from the encircling sleeve to the opposite end of the tube there is an encircling sheath 9 made of a dielectric material, such as Teflon. The two tubes extend away from each other in opposite directions, and their outer end portions are bent downwardly into substantially vertical positions. Extending out of the opposite ends of the lower fitting 5 there are similar metal tubes 10 insulated from the bushings 11 screwed into the ends of the fitting. These tubes likewise are enclosed in dielectric sheaths 12.

Four insulated wires 14, 15, 16 and 17 extend down into the upper pipe 1 and two of these wires 14 and 15 branch out into the two upper metal tubes 7. The lower ends of these two wires project a short distance from the outer ends of the tubes, to which they are brazed. They form the upper probe. Preferably, horizontal metal discs 18 also are brazed to the ends of the tubes and to the projecting wires. These discs and the adjoining ends of wires 14 and 15 form a pair of laterally spaced upper electric contacts. The other two wires 16 and 17 extend down through the lower pipe 4 and out through the two lower tubes 10. The exposed ends of these wires are brazed to the tubes and form a lower pair of electric contacts 19, which serve as the lower probe.

The length of the upper vertical pipe is such that the metal discs will be located at a level, above which it is desired that fire-suppressing, high expansion foam should not rise. The lower pipe is of such length that the lower pair of contacts will be at a level, below which it is desired that the foam level should not fall. Also, it is desirable that the contacts in each pair be spaced apart horizontally several feet, for example, four feet, in order to allow for an uneven profile of the foam surface and to prevent hangup in a decreasing foam level.

The two probes or pairs of contacts just described limit the upper and lower levels of foam that is generated during a fire in the area containing this apparatus that is protected by an automatic foam generating system. They do this by controlling the action of electric relays that, in turn, control the stopping and restarting of a foam generator that has been set in operation by a suitable fire detection device. The foam generator itself forms no part of this invention, but may include an electric motor (not shown) that is wired to a pair of alternating current power lines 21 and 22 as shown in FIG. 2. Line 21 is connected to the motor directly by a wire 23. The other line is connected to the motor by wires 24 and 25 that are normally electrically connected by the switch 26 of a latch relay 27. A latch relay is one in which the switch remains in the position to which it is moved by a solenoid coil, even after that coil has been de-energized, until another solenoid coil reverses the switch. Thus, the latch relay includes two solenoid coils 28 and 29, the former for closing the switch and the other for opening it. If a water powered foam generator is used, wires 23 and 25 would be connected to its solenoid valves.

The coil that closes the switch is connected to power line 21 by a wire 31 and is connected to the other power line through two normally closed switches 32 and 33, each a part of a different relay. The coil, wire 31 and the two switches form a control circuit. One relay includes a solenoid coil 34 for opening switch 32, and the other relay includes a solenoid coil 35 for opening the other switch 33 and simultaneously closing a normally open switch 36. This last switch is in another control circuit, which connects one end of solenoid coil 29 of the latch relay to wire 24, the other end of the coil being connected to wire 31 leading to power line 21.

The two power lines 21 and 22 supply current to two different transformer-rectifier units 38 and 39, each of which steps down the voltage and feeds direct current to the solenoid coils connected to them. However, neither of these units can energize the associated solenoid coil until a normally open control circuit connected with each unit is closed. The circuit for the first unit includes the lower probe contacts 19 and wires 16 and 17 and is closed when the foam level rises high enough to bridge these contacts and thereby electrically connect them. The circuit to the second unit 39 includes wires 14 and 15 and the upper probe contacts 18, which are bridged by the foam level to close that circuit. The sensitivity of the lower probe circuit can be adjusted to variable resistance 41, and similar resistance 42 permits the sensitivity of the upper probe circuit to be adjusted likewise.

OPERATION

Normally, the electrical system is in the condition shown in FIG. 2. When a fire breaks out, a fire-detection device (not shown) closes a circuit that energizes power lines 21 and 22 and thereby starts the foam generator producing fire-suppressing foam. As the foam rises from the floor it bridges lower probe contacts 19, which act as a switch to close the control circuit connected through unit 38 with relay coil 34, thereby opening normally closes switch 32, but this has no effect on the foam production. Therefore, the foam will continue to rise until it engages upper contact discs 18, which closes the control circuit connected through unit 36 with relay coil 35. Energizing this coil causes it to open normally closed switch 33 and simultaneously close normally open switch 36. Discs 18 assure positive contact with the foam, even when the surface bubbles of the foam are large. Closing of switch 36 energizes latch relay coil 29 to open switch 26 and thereby break the foam generator circuit, so foam generation stops.

Without continuing foam generation, the foam will settle and draw away from discs 18, as indicated by broken line 43 in FIG. 3, so relay coil 35 will be de-energized and switch 36 will open and switch 33 close as shown. However, latch relay switch 26 will remain open because switch 32 is still open. If the foam level later falls below the lower probe contacts 19 so that coil 34 is de-energized, switch 32 will close again and latch relay coil 28 will be energized to close switch 26, thereby restarting foam generation to repeat the cycle until the power to lines 21 and 22 is shut off.

By automatically controlling the foam level in the protected area, foam solution is conserved for more effective use later, thereby extending the operational capacity of the system. Foam level control, such as described herein, also keeps foam away from ceiling-mounted smoke and flame detectors, lights and other objects that may be located near ceiling level.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Apparatus for controlling the level of fire-suppressing foam delivered by a foam generator to a predetermined area, comprising an electric circuit for activating such a generator, a switch in said circuit, electrically operated means for opening and closing said switch, control circuits for operating said means, a pair of laterally spaced lower electric contacts mounted in said area in one of said control circuits and adapted to be bridged by a rising level of foam to close that control circuit, and a pair of laterally spaced upper electric contacts mounted in said area above the level of said lower contacts and isolated therefrom, said upper contacts being disposed in another of said control circuits and adapted to be bridged by a rising level of foam to close the last-mentioned control circuit.

2. Apparatus according to claim 1, in which said switch forms part of a latch relay, and said electrically operated means include a pair of solenoid coils in said relay for opening and closing the switch.

3. Apparatus according to claim 2, in which said electrically operated means also include a pair of relays electrically connected with said coils, and each of said pair of relays includes a solenoid coil energized by one of said control circuits when said pair of contacts of that circuit are bridged by foam.

4. Apparatus for controlling the level of fire-suppressing foam delivered by a foam generator to a predetermined area, comprising an electric circuit for activating such a generator, a latch relay in said circuit, a first control circuit connected with said relay for closing it, a first normally closed solenoid switch in said control circuit, a second normally closed solenoid switch in series with said first solenoid switch, a second control circuit connected with said relay for opening it, a normally open solenoid switch in said second control circuit, a normally open third control circuit for opening said first normally closed switch, a pair of laterally spaced lower electric contacts in said third control circuit for mounting in said area in position to be bridged by a rising level of foam to close said third control circuit and thereby open said first normally closed switch, a normally open fourth control circuit for opening said second normally closed switch and closing said normally open switch, and a pair of laterally spaced upper electric contacts in said fourth control circuit for mounting in said area above the level of said lower pair of contacts in position to be bridged by a rising level of foam to close said fourth control circuit and thereby open the second normally closed switch and close the normally open switch, whereby to open the latch relay to stop foam generation until the foam level falls below said lower pair of contacts.

5. Apparatus for controlling the level of fire-suppressing foam delivered by an electric generator to a predetermined area, comprising an electric circuit for energizing such a generator, a switch in said circuit, electrically operated means for opening and closing said switch, control circuits for operating said means, an upright supporting member in said area, a first pair of arms extending laterally in opposite directions from said member, a pair of laterally spaced lower electric contacts in one of said control circuits and connected to the outer ends of said arms for bridging by a rising level of foam to close that control circuit, a second pair of arms extending laterally in opposite directions from said supporting member above the level of the first pair of arms, and a pair of laterally spaced upper electric contacts in another of said control circuits and connected to the outer ends of said second pair of arms above the level of said lower contacts for bridging by a rising level of foam to close the last-mentioned control circuit.

6. Apparatus according to claim 5, in which said arms and supporting member are tubes communicating with one another, and said control circuits include wires extending from said contacts through said arms and supporting member.

7. Apparatus according to claim 5, in which the outer end portion of each arm extends downwardly and has the adjoining electric contact on its lower end.

8. Apparatus according to claim 7, including a disc encircling and mounted on each downwardly extending portion of the second pair of arms and forming the contacts carried thereby.

* * * * *